US006983868B1

(12) United States Patent
Harris

(10) Patent No.: US 6,983,868 B1
(45) Date of Patent: Jan. 10, 2006

(54) FUEL CONTAINER

(76) Inventor: Roger Harris, 2417 Troy Dr., East Moline, IL (US) 61244

( * ) Notice: Subject to any disclaimer, the term of this patent is extended or adjusted under 35 U.S.C. 154(b) by 0 days.

(21) Appl. No.: 10/948,376

(22) Filed: Sep. 23, 2004

(51) Int. Cl.
*A47G 19/00* (2006.01)

(52) U.S. Cl. ..... 222/470; 222/557; 222/571; 141/392

(58) Field of Classification Search ..... 141/1, 141/2, 98, 192, 206, 209, 311 A, 392; 222/460, 222/470, 472, 473, 556, 557, 571
See application file for complete search history.

(56) References Cited

U.S. PATENT DOCUMENTS 2,717,102 A * 9/1955 Rives ..... 222/89
3,951,315 A * 4/1976 Glodek ..... 222/491
4,125,207 A 11/1978 Ernst et al.
4,273,265 A * 6/1981 Anderson ..... 222/189.01
4,274,556 A 6/1981 Thiessen
4,351,453 A * 9/1982 Walker ..... 222/83.5
4,384,662 A * 5/1983 Boudin et al. ..... 222/484
4,746,036 A 5/1988 Messner
5,226,574 A 7/1993 Durinzi, Jr.
5,692,626 A 12/1997 Wehrle et al.

* cited by examiner

*Primary Examiner*—Timothy L. Maust
(74) *Attorney, Agent, or Firm*—Sturm & Fix LLP

(57) ABSTRACT

A fuel container having novel dispensing devices is disclosed. A hose or spout is fitted with a funnel, both being sufficiently clear to permit the visual detection of the free surface of the fuel within. At the juncture between the spout and the funnel, a valve is provided. The valve is thumb operated, so only one hand is required to open and close the valve. A carrying strap and a handle help make the fuel container portable. A window strip in the fuel container permits the user to observe the level of the fuel within.

9 Claims, 2 Drawing Sheets

Fig. 2
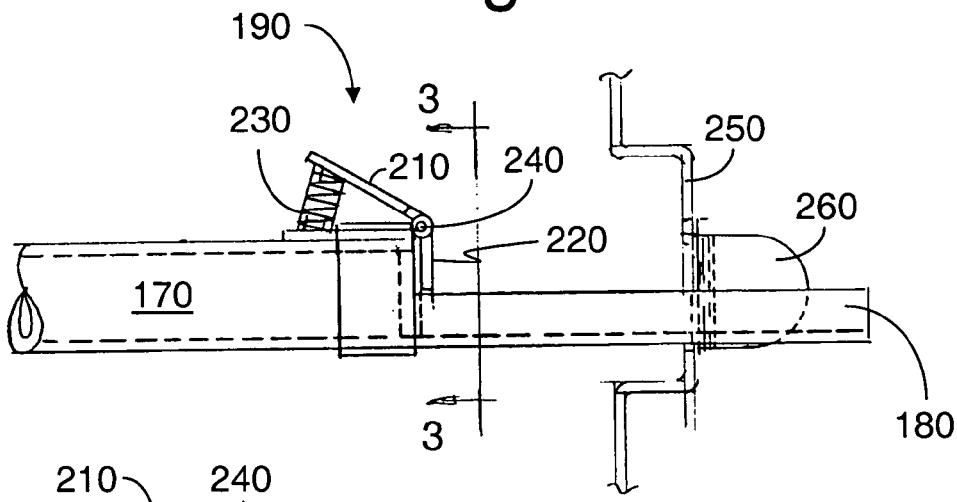
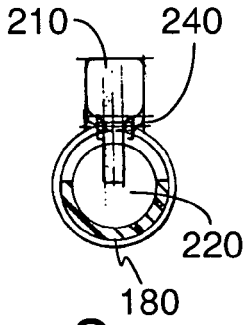
Fig. 3
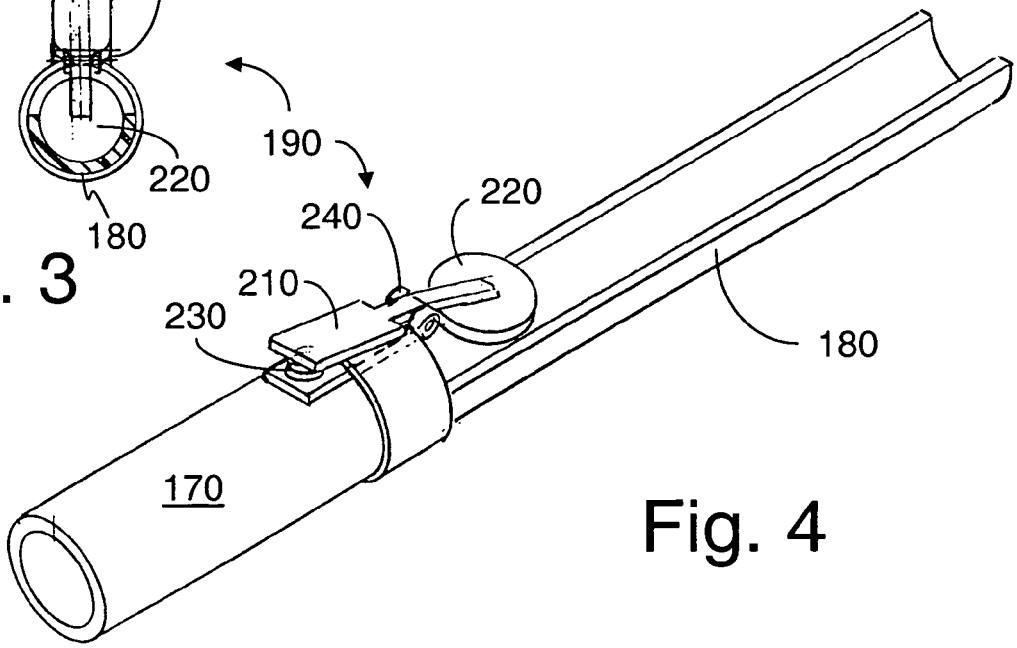
Fig. 4

FUEL CONTAINER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

AUTHORIZATION PURSUANT TO 37 C.F.R. § 1.71(d)(e)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to storage, transport, and dispensing containers for fuels. More particularly, this invention relates to a container having a novel dispensing arrangement for storing and dispensing of fuels, especially gasoline and diesel fuel.

2. Background Art

Storage containers with spouts have been used for many years for storing, transporting, and dispensing fuels, most especially gasoline due to its common use. Most often a spout is provided for dispensing the fuel from the container to a destination such as a fuel tank for an automobile, lawn mower, lamp, stove, another storage container used for mixing fuel and oil for two-stroke engines, etc. Commonly, the spout is flexible, but rigid spouts have been included with fuel containers. Frequently, the spout is removed for transport and compact storage.

Visually, typical spouting presents a difficulty in avoiding spillage. The spouts provided on present-day fuel containers are opaque. The presence and location of fuel within the spout is not known until the fuel exits the spout, at which time, the spout may be oriented or aimed imprecisely for dispensing the fuel to its desired destination.

Usually, a cap or plug is included to seal off the spout if the spout is not removed for transport. When no provision for plugging the spout is provided, or the provision is unused, there is danger of fuel being spilled during transport, as well as evaporation of the fuel. Evaporation is both wasteful and dangerous. If a plug or cap is provided, it may easily be misplaced, especially at the gasoline pump where such plugs are sometimes left behind. In addition, when the contents of a fuel container warm up, pressure may build up inside the container, causing a plug to eject from its place in the spout. Finally, a place must be found for the plug or cap when pouring fuel. Often, the surroundings of the fuel tank are unsuitable for keeping the plug or cap clean.

In U.S. Pat. No. 4,746,036 Messner disclosed a gasoline container having a significantly rigid spout having a plug.

The plug is removed from the end of the spout for dispensing the fuel by pressing on a spring loaded rod opposite the dispensing end of the spout. The plug and actuation assembly disclosed by Messner is complex and expensive to manufacture.

There is therefore, a need for a fuel container having a translucent or transparent, flexible spout and a simple, thumb-activated valve.

BRIEF SUMMARY OF THE INVENTION

It is an advantage of the present invention to provide a flexible spout or hose on a portable fuel container. Such a spout or hose will be translucent or transparent so the fuel will be visible from the outside of the spout. Over the past several decades, plastics have been developed that are inexpensive and resistant to chemical reaction. In addition, they are light and versatile. A flexible or rigid plastic hose or spout, sufficiently transparent for a user to clearly see the free surface of the fuel being delivered by the spout, is quite feasible.

A transparent or translucent funnel affixed to the end of the spout represents another advantage of this invention. Such a funnel may take the form of a roughly truncated cone shape, having a smaller cross-sectional area at a discharge end than an end connected to the spout. The cross-section of the funnel may also take the form of a semicircle, being open at the top and providing an open channel through which the fuel flows with a free surface.

In either case, the discharge end of the funnel is sufficiently small in dimensions to fit into a fuel port for dispensing. The size may vary depending on the application. If the fuel container is to be used for fueling modern automobiles and trucks, the funnel shall also be sufficiently rigid so the flap found in the goose-neck of the fuel tanks of such vehicles may be pushed open for fueling.

An additional advantage of the present invention is the inclusion of a simple, thumb-operated valve near the end of the spout. The valve may be actuated with the same hand holding and controlling the spout. The valve is attached to the spout or the funnel, so it will not be misplaced or forgotten, nor will pressure inside the container cause it to eject. Preferably, the valve is located between the spout discharge and the funnel inlet. In this way, the valve is effective in stopping the flow of fuel, while being out of the way when dispensing the fuel.

For the purposes of this application, the term "clear" is hereby defined as passing sufficient light such that a free surface of a liquid fuel is discernable in normal daylight. Therefore, clear covers both transparent and sufficiently translucent for the purposed of this invention.

BRIEF DESCRIPTION OF THE DRAWINGS

FIG. 2 is a side elevation of a funnel having a valve for the fuel container of the present invention;

FIG. 3 is a frontal elevation view of the valve for use with the fuel container of the present invention; and FIG. 4 is a perspective view of the funnel and valve used with the fuel container of the present invention.

DETAILED DESCRIPTION OF THE INVENTION

Figure 1:
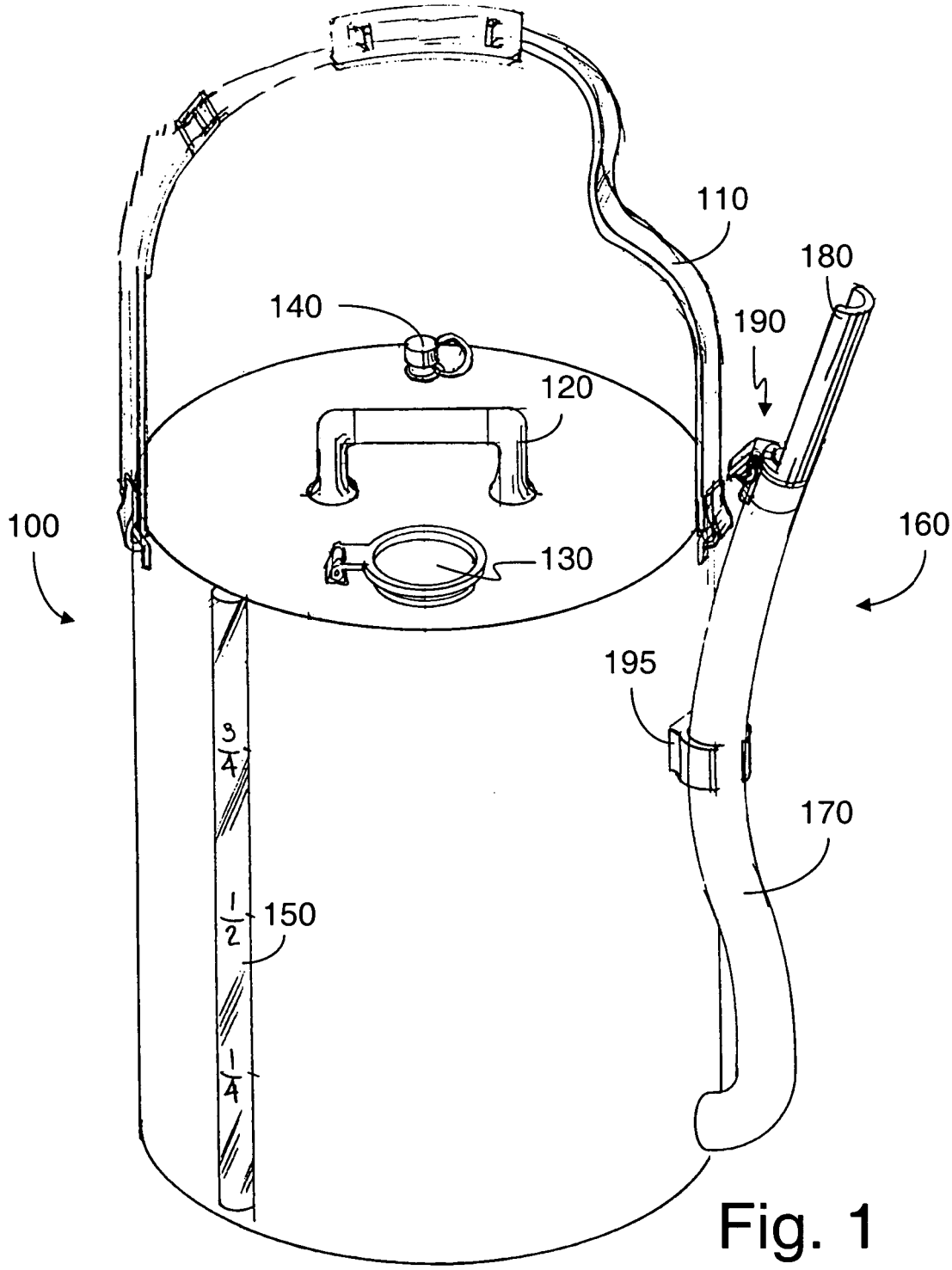
FIG. 1 is a perspective view of a portable fuel container of the present invention.

In FIG. 1, a fuel container 100 having the advantages previously listed is shown. In addition to the advantages mentioned, the fuel container 100 shown in FIG. 1 is portable and the transport features comprise a carrying strap 110 and a handle 120. The fuel container 100 may be filled through a filling port 130. While dispensing fuel, air is permitted to enter the fuel container 100 via an air vent 140 which is preferably located opposite the discharge port to assure an air pocket under the air vent 140 while pouring. A window strip 150 permits a fuel can user to visually detect the level of the fuel in the fuel container 100.

A fuel spout assembly 160 is provided for dispensing the liquid fuel from the fuel container 100. The spout assembly 160 preferably comprises a flexible, clear hose or spout 170, a clear funnel 180 and a valve assembly 190. A spout clamp 195 may be provided to keep the spout 170 in a roughly vertical position as shown in FIG. 1.

The funnel 180 and valve assembly 190 are detailed in FIGS. 2–4. The funnel 180 is preferably a channel, having a half-circular cross-section as is most clearly seen in FIGS. 3 and 4. When fueling a motor vehicle 250, the funnel 180 will preferably be sized and sufficiently rigid to provide the force required to open the flap 260 installed in modern motor vehicle fuel tank ports.

The valve assembly 190 comprises a thumb tab 210, a stopper 220, and a spring 230. The spring 230 may be a coil spring, a leaf spring, an elastic member, or any configuration providing a force to hold the disk-shaped stopper 220 in a closed position while permitting a user to open the stopper by countering the closing force. This is effected by pressing the thumb tab 210 toward the spout 170. The thumb tab 210 may be rigidly affixed to the stopper 220, or gearing may be provided to accentuate the angular displacement of the stopper 220 relative to a hinge 240, compared to the angular displacement of the thumb tab 210, also relative to the hinge 240. In other words, it may prudent to have the rotation of the stopper 220 from fully closed to fully open to be near 90°, while the thumb tab 210 may only rotate 40°, for instance.

To use the fuel container 100 of the present invention, the fuel container 100 is positioned at a suitable elevation for the fuel to gravity flow to the dispensing point. The spout 170 is removed from the spout clamp 195 and the funnel 180 placed in position to dispense fuel to the desired destination. The operator applies pressure to the thumb tab 210 at which time the valve stopper 220 pivots upward to permit the fuel to flow from the spout 170 to the funnel 180 and to the fuel's destination. The flow of fuel may be terminated at any time by releasing the user's force on the thumb tab 210. The stopper 220 will return to its place keeping the fuel from exiting the spout 170.

The above embodiment is the preferred embodiment, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

I claim:

1. A fuel container for storage and dispensing of liquid fuels, the fuel container comprising:

(a) a container;

(b) a spout having a cross-sectional shape, a first end of said spout being operatively attached to and open to the container;

(c) a funnel fitted to a second end of said spout;

(d) a valve comprising:

a stopper being shaped to fit the cross-sectional shape of the spout and oriented to fill the cross-section of the spout when in a closed position, and rotated so as to not fill the cross-section of the spout when in an open position;

a thumb tab operatively attached to the stopper such that, when the thumb tab is rotated about an axis, the stopper pivots between the open and closed positions;

a hinge on which the stopper pivots; and an elastic member providing a force to hold the stopper in a closed position, said force being countered by a user when pivoting the stopper to its open position.

2. The fuel container of claim 1 wherein the valve is located at the second end of the spout.

3. The fuel container of claim 1 wherein the thumb tab and the stopper are rigidly, operatively connected.

4. The fuel container of claim 1 wherein the elastic member comprises a spring.

5. The fuel container of claim 1 wherein the spout's cross sectional shape is round and stopper is disk shaped.

6. The fuel container of claim 1 wherein the spout is clear.

7. The fuel container of claim 1 wherein the spout is flexible.

8. The fuel container of claim 1 wherein the funnel is clear.

9. The fuel container of claim 1 wherein the funnel comprises a channel, open at the top when in use dispensing fuel.

* * * * *